US005655319A

United States Patent [19]

LeCompte

[11] Patent Number: 5,655,319

[45] Date of Patent: Aug. 12, 1997

[54] PERPETUAL RECORDING CALENDAR

[76] Inventor: George W. LeCompte, 8620 N. Pomona Rd., Tucson, Ariz. 85704-2249

[21] Appl. No.: 410,961

[22] Filed: Mar. 27, 1995

[51] Int. Cl.[6] ..... G09D 3/00

[52] U.S. Cl. ..... 40/107; 40/119

[58] Field of Search ..... 40/107, 119, 121; 283/2, 4; 281/2, 5

[56] References Cited

U.S. PATENT DOCUMENTS

| | | | |
|---|---|---|---|
| 1,286,058 | 11/1918 | Morris . | |
| 1,494,133 | 5/1924 | Ringler | 40/107 |
| 1,848,634 | 3/1932 | Kruger | 40/107 |
| 2,575,929 | 11/1951 | Roesholm . | |
| 2,768,459 | 10/1956 | Corbett . | |
| 2,815,596 | 12/1957 | Russell | 40/115 |
| 3,427,740 | 2/1969 | Heskes . | |
| 3,883,971 | 5/1975 | Weiss | 40/119 |
| 4,813,707 | 3/1989 | Habib | 283/2 |
| 5,123,191 | 6/1992 | Kim | 40/120 X |
| 5,329,711 | 7/1994 | Dewey | 40/119 |

*Primary Examiner*—Brian K. Green

[57] ABSTRACT

A perpetual calendar 1 which is set by folding back portions at the right and left sides of a month panel 2. Day-of-the-week designators 7 appear on a separate heading panel 3 above the seven displayed columns of date boxes 9. The user makes event entries 8 in the date box 9 marked with the appropriate date number 10. The date for each, month has thirteen columns of date boxes 9 marked with a redundantly extended array of date numbers 10. Date numbers 10 on each month panel 2 begin at the top of the middle column. The month panel 2 is folded back on scored lines between the columns so that only the appropriate seven columns are displayed. Hidden behind the heading panel 3 are year number markings 21 indicating the creases for each year. The month panel 2 for each month is identified by a month label 18 placed at the bottom of the center column so as to always be displayed. Because of redundancy in the date number array, event entries 8 must be duplicated unless they fall in the center column.

4 Claims, 4 Drawing Sheets

PERPETUAL RECORDING CALENDAR

BACKGROUND OF THE INVENTION

1. Field of the Invention

The invention relates to a perpetual calendar, and more specifically to a perpetual calendar which accommodates permanent notes for birthdays and other anniversaries on a conventional full-month display.

2. Description of Related Art

Many perpetual calendars have been developed which display the days of each month in seven columns corresponding to the days of a week. They all depend on the finite number of combinations that occur; a month can only start on one of seven days and have one of four lengths: 28, 29, 30 or 31 days. Many of the existing designs employ lists or look-up tables to identify which of 7 to 28 displays to use for a given month and year. Others have a date panel with a redundantly extended array, in which dates are repeated in thirteen or more columns, behind a mask which is aligned to show the correct seven columns. These "slide calendars" may be set to a code from a look-up table or by alignment of month and year on scales which appear on the mask and movable date panel.

The mathematics behind look-up tables or slide calendar scales are straight forward: A normal year of 365 days contains 52 weeks plus one day. Consequently each month will begin one day later in the following year. In leap years (years evenly divisible by 4) February has 29 days, causing March and subsequent months to start two days later than in the previous year. A 28-year repeat cycle occurs; 21 regular years at 1 day plus 7 leap years at 2 days equals 35 days or 7 weeks. Because years divisible by 100 are not leap years unless they are divisible by 400, three out of four centuries have 76 regular years and 24 leap years; $76+24\times2=124$ days, 2 days short of 18 weeks. Thus each century the first-day-of-the-month pattern moves two days earlier. The one-day shift for the leap century brings the total to 7 days, making each of these four-century periods identical.

SUMMARY OF THE INVENTION

The primary objective of the present invention is to provide a continuing reminder of annual events, such as birthdays and other anniversaries. By displaying them on a conventional monthly calendar, they will come to the user's attention much more frequently than occurs with date books currently available for this purpose. By folding back the columns of the date panel that would conventionally be obscured by a mask, the date boxes can be made large enough to accommodate notes. Because all dates except those in the center column appear redundantly, most events must be entered in two boxes. Once this is done the notes will be displayed year after year on an up-to-date monthly calendar. Day-of-the-week column headings are placed on separate panel, aligned to the displayed month panel. This tabular display concept can be used for data elements other than date numbers. The familiar Gregorian calendar is the example used for the preferred embodiment.

DETAILED DESCRIPTION OF PREFERRED EMBODIMENTS

Figure 1:
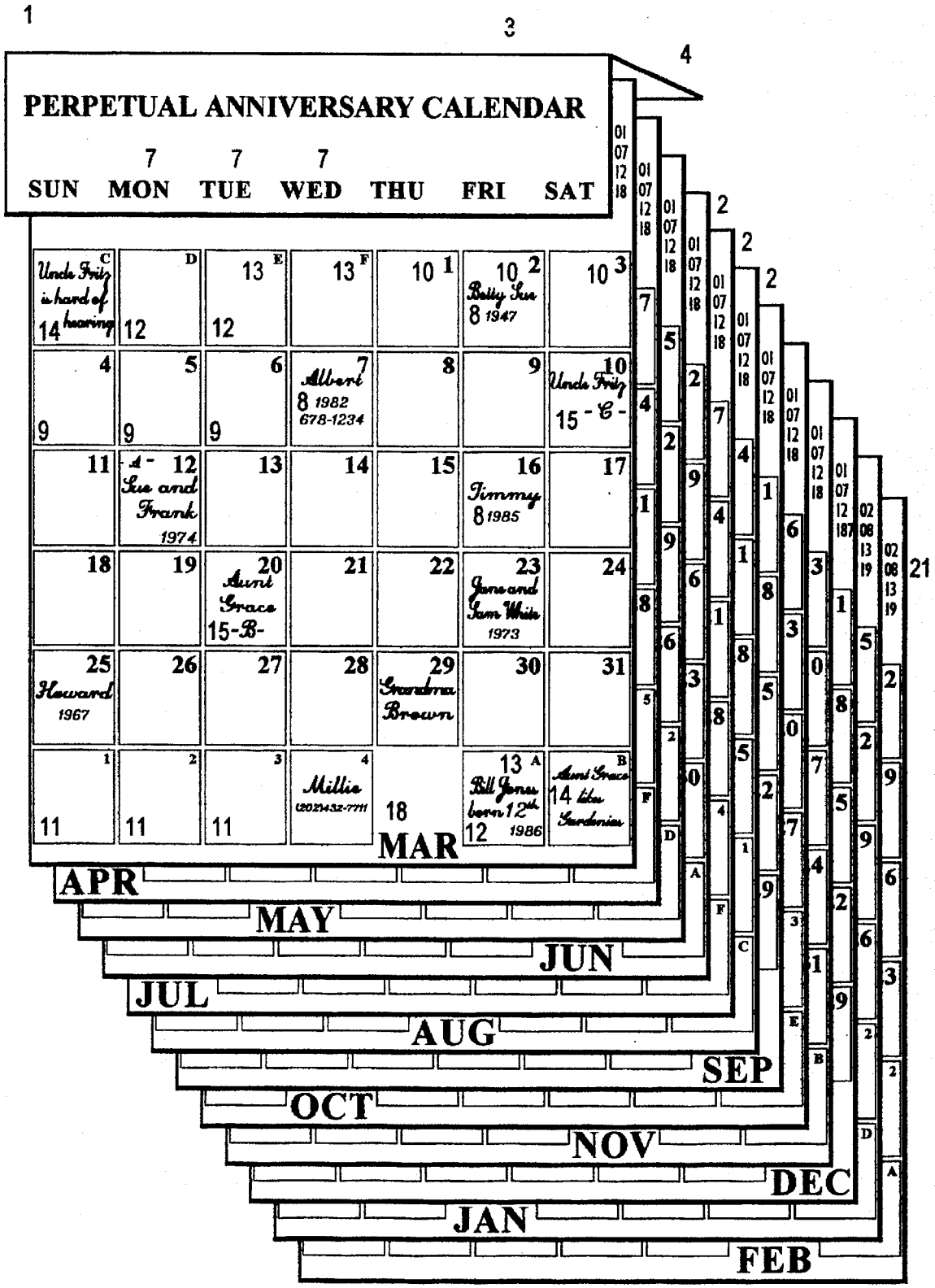
FIG. 1 is a front plan view of the calendar showing the folded date panels enclosed in the constraint panel.

As shown in FIG. 1, the perpetual anniversary calendar 1 has the appearance of the calendars widely used to record appointments and other reminders. An array of date boxes 9 are marked with date numbers 10 and appear in columns under day-of-the-week designators 7. Unlike a conventional calendar, this calendar 1 can be used year after year with the entered notes 8 reappearing on an up-to-date display of the month. As depicted in FIG. 1, the calendar 1 comprises a number of monthly date panels 2 overlaid with a heading panel 3. The heading panel 3 extends beyond the area of the date panel 2 marked with date boxes 9 and is marked with day of the week designators 7. This heading panel 3 can also carry any desired message or decoration. The back flap 4 of the heading panel 3 acts to keep the heading panel 3 positioned at the top of the month panel 2.

For display purposes, the current month panel 2 of the perpetual calendar 1 is placed into a picture frame (not shown) or other container having a transparent front surface. This protects the calendar 1 and also permits it to be used as a conventional appointment calendar, entries being made on the outside of the container with a washable marker. Month panels 2 not being displayed can be stored elsewhere or placed behind the front month panel 2.

As illustrated by examples in script font, the user writes name, year and other pertinent event information 8 in the date box 9 marked with the relevant date number 10. In addition to date boxes 9 for each day of the particular month, there are supplemental date boxes 11 for several days at the beginning of the following month. Also entry annex boxes 12, identified with index letters 13, are provided in which to make overflow entries 14 which cannot be fit into the relevant date box 9. These overflow entries 14 are keyed to the date by reference letters 15 written into the date boxes 9.

Figure 2:
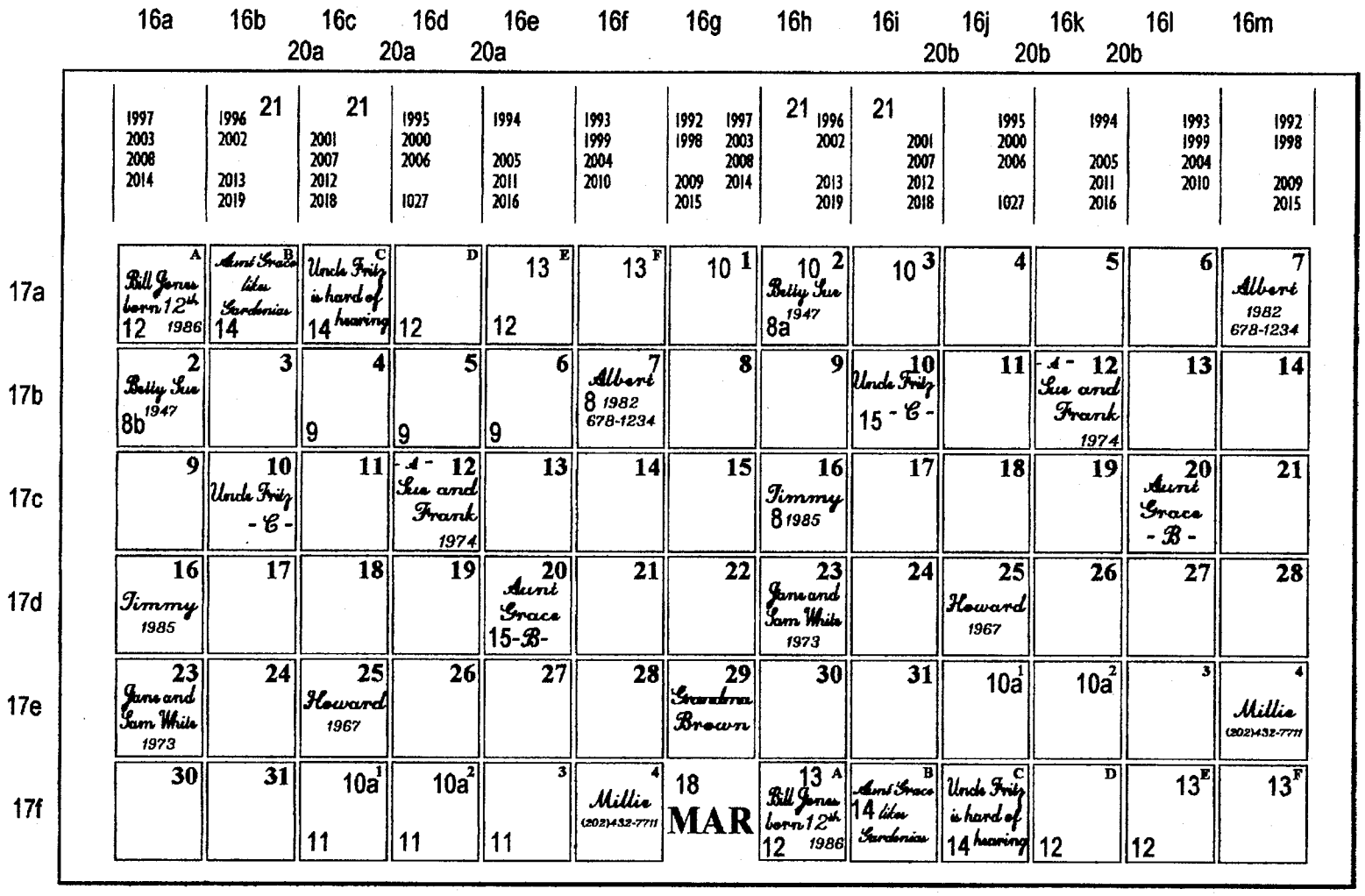
FIG. 2 is a front plan view of one of the monthly date panels in an unfolded state.

A representative date panel 2, shown unfolded in FIG. 2, has thirteen columns 16 and six rows 17. Date numbering 10 begins at the top of the center column **16*g* in the top row 17*a* and progresses to the right. Date numbering 10 in the second row 17*b* begins with the number two resulting in the number eight appearing below number one in the center column 16*g*. The remainder of this redundantly extended array is filled such that each date box 9 contains a date number 10 increased by seven from the date number 10 above it. The month of March, used for the example in FIG. 1, has 31 days. Accordingly,supplemental date boxes 11 to the right of the two date boxes 9 marked with 31 as the date number 10 contain smaller size supplemental date numbers 10*a*** from 1 to 4, corresponding to the first four days of the following month, April.

No date box is placed at the bottom of the center column **16*g* providing space for an abbreviated month label 18. In this position the month label 18 remains visible as the display changes for months starting on different days of the week. The remaining twelve boxes, six at the left side of the top row 17*a* and six at the right side of the bottom row 17*f* are entry annex boxes 12 marked with index letters 13 A through F, so that overflow entries 14 can be keyed to date boxes 9. When written into a date box 9, the index letter 15 alerts the user to the presence of additional information for that date. With the exception of date numbers 10 that fall into the center column 16***g*, there are two date boxes 9 for each date number 10. This requires duplicate entries as illustrated in FIG. 2 by paired data entries 8*a*, 8*b*. The exception is illustrated by a center column 16*g* event entry 8*c* for March 29th.

To facilitate the folding that results in a non-redundant display, a date panel 2 made of paper should have creases 20 along the fold lines between the columns 16. At the top of the date panel 2 each crease 20 is marked with year numbers 21 indicating the years for which the date panel 2 is folded back at that crease 20. For one 28-year cycle each crease 20 is used four times. The year numbers 21 appear sequentially, moving from right to left along six rows. The seven creases 20*a* in the left half of the date panel 2 have an array of year numbers 21 identical to that appearing at the seven creases 20*b* in the right half of the date panel 2.

Figure 3:
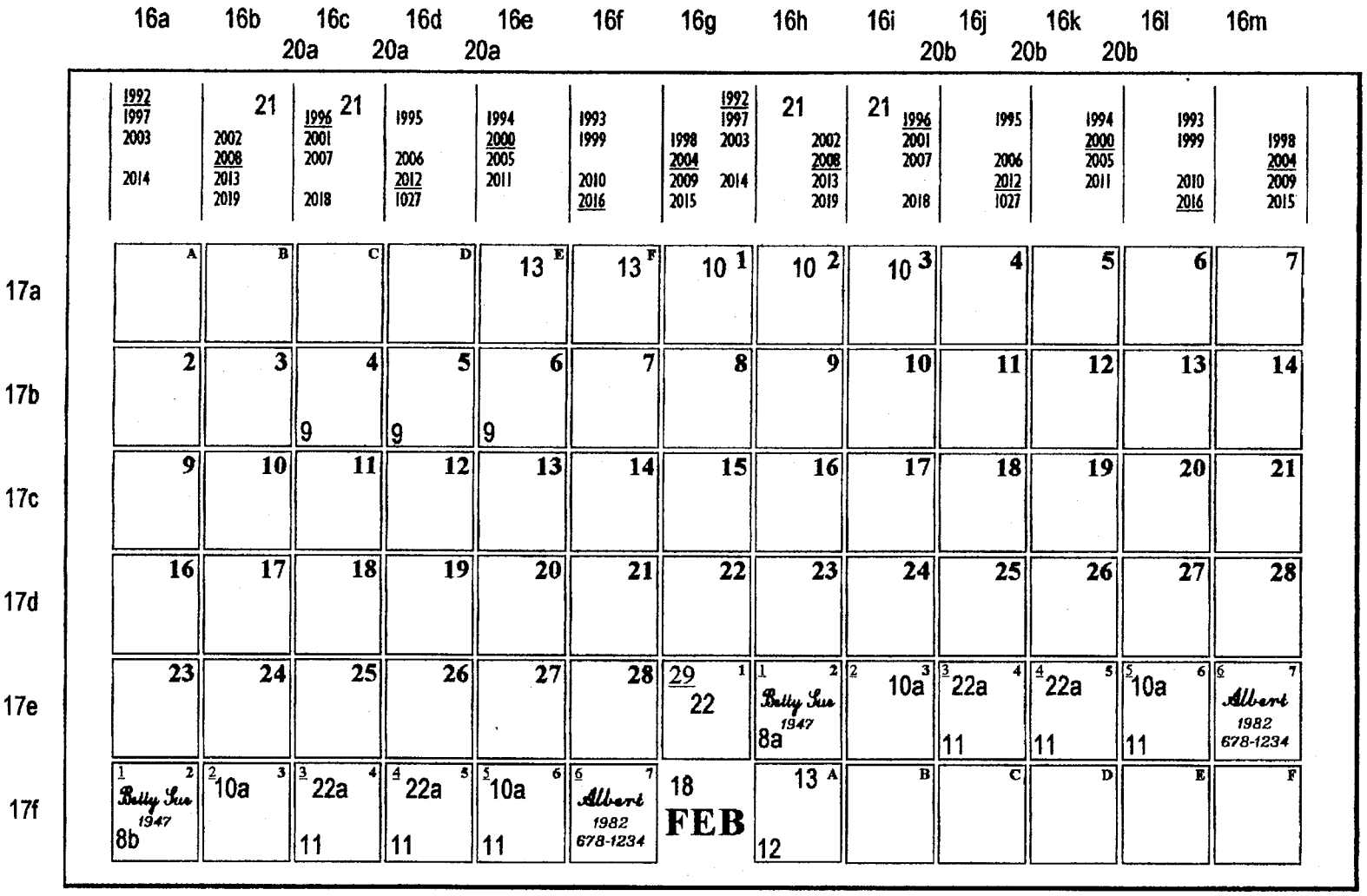
FIG. 3 is another front plan view of a monthly date sheet for the first embodiment showing unique markings for the month of February.

February, having twenty eight days in normal years and twenty nine in leap years, requires special treatment. FIG. 3 illustrates how this is accommodated by use of a contrasting font (underlined characters in the example) for date numbers 10 that differ in leap years. These leap year numbers 22 are placed in the supplemental date boxes 11 to the right of the date box 9 having 28 as its date number 10 and in the supplemental date boxes 11 at the left side of the bottom row 17*f*. In the supplemental date boxes 11 for February the small leap year numbers 22*a* serve to inform the user that event entries 8 made for the normal supplemental date numbers 10*a* are delayed (moved to the right) by one day in leap years.

For normal years, when February is exactly four weeks long, its date panel 2 is folded the same as the one for March. For leap years the additional day causes the folds to be displaced one column 16 to the right. Thus in FIG. 2 the sequence of year numbers 21 on the creases 20 for March advances two columns 16 at each leap year and for February this two-column advance occurs for the years following leap years as shown in FIG. 3.

Date panels 2 for the other months are of the same form. Provided the date boxes 9 are printed in close registration, the date panels 2 for the 12 months can be printed on six sheets, using both sides.

Figure 4:
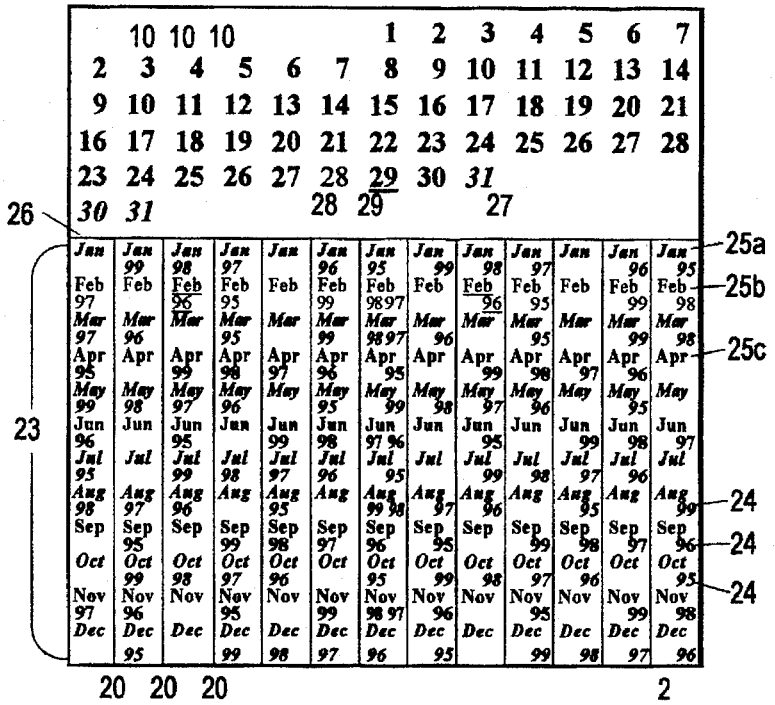
FIG. 4 is an alternate embodiment in an unfolded state.

The two arrays of year numbers 21 on the creases 20 must be shifted to produce the other six phasings of date numbers 10 relative to day-of-the-week designators 7. These alignment shifts for the year number 21 arrays are illustrated by the single-panel calendar shown in FIG. 4. Because the setting table 23 for the calendar in this example has only a single row of year numbers 24 for each row of month indicators 25 the range of settings only covers five or six years.

To accommodate months of different length on a single date panel 2 the date numbers at the end of the month 27, 28, 29 are marked using distinctive fonts, the same fonts being used for the month indicators 25 and year indicators 24 in the setting table 23. In the example, month and year indicators 25*a* for 31-day months and the date number 31 27 are in bold italics, the date number 28 28 and month indicators for February 25*b* and are in normal font, date number 29 29 and leap years in the February year number row 25*b* are underlined, and month and year indicators for 30-day months 25*c* are in normal bold font.

Figure 5:
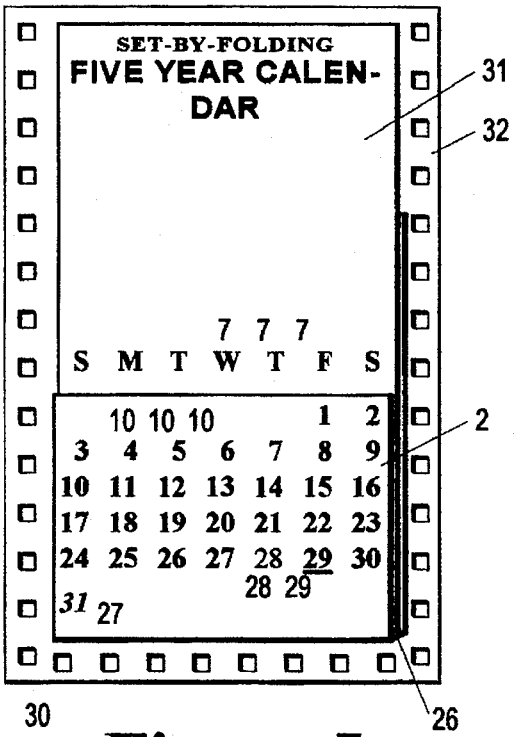
FIG. 5 a frontal view of the alternate embodiment when folded and enclosed in a transparent case.
Figure 6:
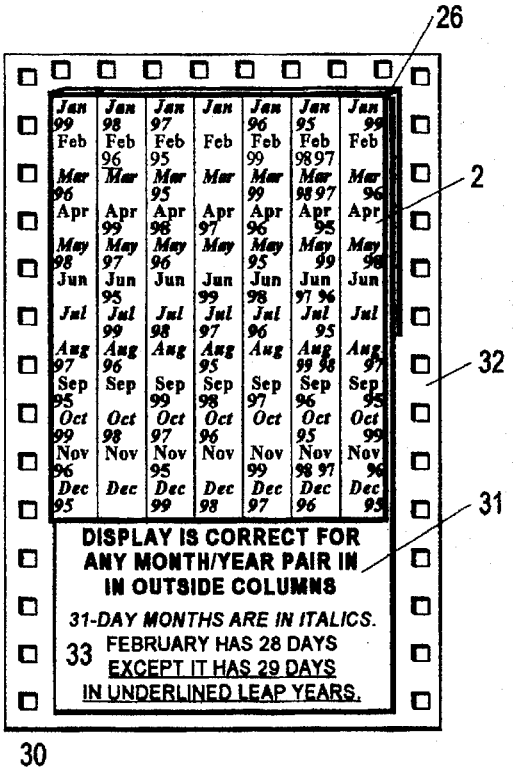
FIG. 6 is a rear view of the alternate embodiment.

By folding the panel 2 back on the column divider lines 20 marked for a specific month-year combination, a seven column calendar is formed. Subsequently folding again along the horizontal crease 26 results in a compact calendar display 30. It can be combined with a title panel 31 marked with the designators for the days of the week 7 and inserted into a transparent case 32 with both the date numbers 10 and the table of month and year indicators 23 visible as shown in FIGS. 5 and 6. The back side of the title card 31 includes definitions 33 for the distinctive fonts 27,28 and 29. Additional operating instructions can be placed on the back of the title card 31 in the space covered by the folded month panel 2. The front of the title card 31 has space for an advertising message or business card imprint.

The preferred embodiments described above and represented in the drawings constitute a practical and familiar applications of the invention. The claims which follow are intended to include other calendar formats and any sequential set of numbers, characters or icons for which a phase-adjustable display is desired.

What is claimed is:

1. A perpetual recording calendar comprising twelve distinct month panels, one of the month panels for each of the twelve months of the year, each of said month panels being marked with month label indicia and having indicia marking a thirteen-column, six-row array of date boxes to accommodate entry of notes for each individual date, said date boxes being marked with date numbers in a redundantly extended array beginning in row one of column seven and continuing through a last date number for a respective month, and each of said month panels having a plurality of vertical creases, the plurality of vertical creases being formed between adjacent columns for selective folding to form a seven column display.

2. The perpetual recording calendar of claim 1 between adjacent columns for selective folding to form a seven column display, further comprising, on each of said month panels, two arrays of year number markings adjacent to said vertical creases indicating where said month panels are to be folded so as to form said seven column display.

3. The perpetual recording calendar of claim 2 further comprising a heading panel which obscures said year number markings, said heading panel being marked with day-of-the-week designators aligned to said seven column display.

4. A perpetual recording calendar comprising twelve distinct month panels, one of the month panels for each of the twelve months of the year, each of said month panels being divided by vertical creases into fifteen columns, thirteen of said columns being columns of equal width and two of said columns of each of said month panels having a width half the width of said columns of equal width, each of said month panels including indicia marking between said vertical creases a thirteen-column, six-row array of date boxes, thirty five of said date boxes being marked with date numbers in a redundantly extended array beginning with a "1" in row one of column seven in said array of date boxes, continuing through a last date number for the respective month and followed by supplemental date numbers for a following month for a total of thirty five of said date numbers and said supplemental date numbers, month label indicia in row six of column seven in said array of date boxes, year number markings adjacent to said vertical creases indicating where said month panels are to be folded so as to form a seven column display, and a heading panel which obscures said year number markings, said heading panel being marked with day-of-the-week designators aligned to said seven column display.

* * * * *